US008857086B2

(12) United States Patent
Adams et al.

(10) Patent No.: US 8,857,086 B2
(45) Date of Patent: Oct. 14, 2014

(54) FLEX MOUNT TERMINAL MARKER

(75) Inventors: Michael Scott Adams, Cumming, GA (US); David Scott Morrison, Cumming, GA (US); Jennifer Lynn Schwert, Atlanta, GA (US)

(73) Assignee: Panduit Corp., Tinley Park, IL (US)

( * ) Notice: Subject to any disclaimer, the term of this patent is extended or adjusted under 35 U.S.C. 154(b) by 28 days.

(21) Appl. No.: 13/611,155

(22) Filed: Sep. 12, 2012

(65) Prior Publication Data

US 2014/0068983 A1 Mar. 13, 2014

(51) Int. Cl.
*G09G 1/10* (2006.01)
*G09F 1/10* (2006.01)

(52) U.S. Cl.
CPC ..... *G09F 1/10* (2013.01)
USPC ..... 40/658; 40/647

(58) Field of Classification Search
USPC ..... 40/658, 647, 648
See application file for complete search history.

(56) References Cited

U.S. PATENT DOCUMENTS

| | | | | |
|---|---|---|---|---|
| 1,996,664 | A * | 4/1935 | Walker | 281/30 |
| 2,746,189 | A * | 5/1956 | Bass | 40/622 |
| 3,921,798 | A | 11/1975 | Dean et al. | |
| 4,258,487 | A | 3/1981 | Hohorst | |
| 4,539,766 | A * | 9/1985 | Fast | 40/638 |
| 4,637,676 | A | 1/1987 | Simonsen et al. | |
| 4,649,658 | A | 3/1987 | Sarton et al. | |
| 5,080,607 | A | 1/1992 | Cristescu | |
| 5,338,224 | A | 8/1994 | Blanke et al. | |
| 5,579,907 | A * | 12/1996 | Kedski | 206/307.1 |
| 5,613,874 | A | 3/1997 | Orlando et al. | |
| 5,638,624 | A | 6/1997 | Cornu | |
| 5,700,986 | A | 12/1997 | Rurup et al. | |
| 5,741,153 | A | 4/1998 | Schwer | |
| 6,298,526 | B1 * | 10/2001 | Baumdicker et al. | 24/559 |
| 6,793,524 | B2 * | 9/2004 | Clark et al. | 439/536 |
| 7,740,282 | B2 | 6/2010 | McNutt et al. | |
| 7,963,056 | B1 | 6/2011 | Mangone, Jr. | |
| 2011/0005110 | A1 | 1/2011 | Wieneke | |
| 2011/0279841 | A1 | 11/2011 | Reibke | |

FOREIGN PATENT DOCUMENTS

| | | | |
|---|---|---|---|
| DE | 1857546 | U | 8/1962 |
| DE | 8404741 | U1 | 10/1985 |

(Continued)

OTHER PUBLICATIONS

Wago® Innovative Connections, WMB Multi Marking System Data Sheet, 2 pages, Mar. 21, 2012.

(Continued)

*Primary Examiner* — Casandra Davis
(74) *Attorney, Agent, or Firm* — Christopher S. Clancy; Aimee E. McVady

(57) ABSTRACT

The present invention is directed toward a terminal marker used to identify a terminal block. The terminal marker includes a front having a print surface, a back, sides, and flexible legs. The flexible legs can be positioned in a natural state for installation in the terminal block or a compressed state for obtaining a marking from a printer. In the natural state, the flexible legs extend at an angle with respect to the print surface of the terminal marker. In the compressed state, the flexible legs extend outward beyond of the sides of the terminal marker.

8 Claims, 15 Drawing Sheets

(56) References Cited

FOREIGN PATENT DOCUMENTS

| | | | |
|---|---|---|---|
| DE | 19747663 | A1 | 6/1998 |
| DE | 20303475 | U1 | 5/2003 |
| DE | 202004009980 | U1 | 12/2005 |
| EP | 0552413 | B1 | 6/1996 |
| EP | 2214267 | A1 | 8/2010 |
| FR | 2849291 | A1 | 6/2004 |

OTHER PUBLICATIONS

Phoenix Contact, KLM-1 Terminal Strip Markers, 3 pages, Jan. 22, 2010.
Wieland Marking Tags, http://us1.activepoint.com/Newark_2011/print.html?uid+1332365588290, 1 page, printed Mar. 21, 2012.
Wiedlüller Terminal Marker catalog pages, 18 pages, date unknown.

* cited by examiner

FLEX MOUNT TERMINAL MARKER

FIELD OF THE INVENTION

The present invention relates to terminal markers, and more particularly, to a terminal marker with legs that can be compressed when the terminal marker is fed through a roll-fed, thermal transfer printer.

BACKGROUND OF THE INVENTION

Terminal blocks have been labeled via adhesive backed labels that are affixed to the front surface of terminal blocks for identification. However, the surface of terminal blocks are irregular and inconsistent from block to block resulting in poor adhesion of these labels that are vulnerable to unintentional removable by inadvertent physical contact or adhesive deterioration over time leaving the terminal blocks unidentifiable.

FIGS. 1 and 1A illustrate the most common method used for identifying terminal blocks. The terminal block markers 60 are formed from a semi-rigid molded plastic material, such as ABS. The terminal markers 60 have mounting latches 64 that protrude from the back of the label surface 62. The mounting latches engage the openings 52 in a terminal block 50 to secure the terminal marker 60 to the terminal block 50. The terminal markers 60 are typically printed on demand using specialized printing systems designed specifically for terminal block markers or manufactured with pre-printed legends. These systems are discrete from other printing operations and typically require discrete software and operator training.

As a result, there exists a need for a terminal marker with the same mounting functionality customers desire while being printable in common roll fed thermal transfer printers using the same software used for standard labeling practices.

SUMMARY OF THE INVENTION

The present invention is directed toward a terminal marker used to identify a terminal block. The terminal marker includes a front having a print surface, a back, and sides. The terminal marker also includes flexible legs that are positioned in a natural installed state. The flexible legs of the terminal marker bend to the compressed state to accommodate printing, and thereafter return to the natural installed state. In the natural installed state, the flexible legs extend downward at an angle with respect to the print surface of the terminal marker. In the compressed state, the flexible legs extend outward from the sides of the terminal marker.

DETAILED DESCRIPTION

Figure 1A:
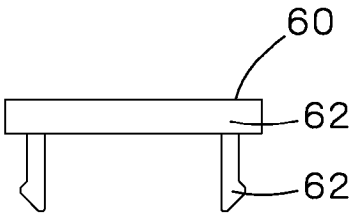
FIG.1A (Prior Art)
FIG. 1A is a front view of the prior art terminal marker of FIG. 1.
Figure 1:
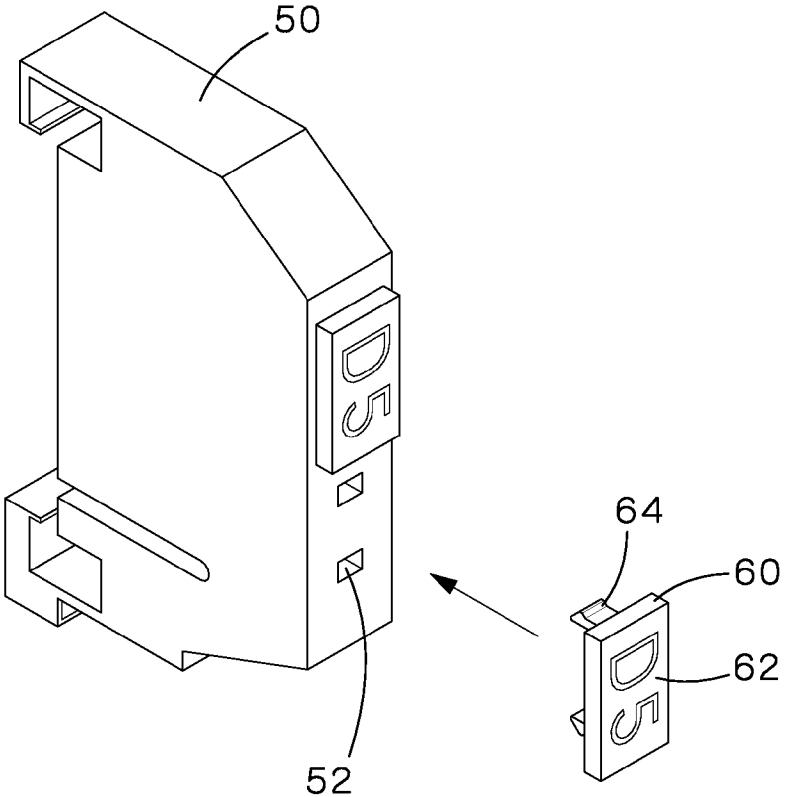
FIG.1 (Prior Art)
FIG. 1 is an exploded perspective view of a prior art terminal marker positioned to be installed in a terminal block.
Figure 2A:
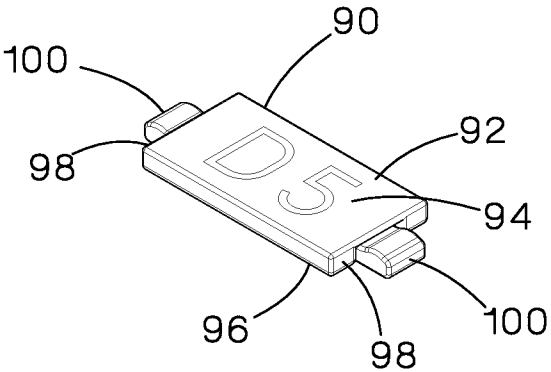
FIG. 2A is a top perspective view of the terminal marker of FIG. 2 in a compressed state.
Figure 2:
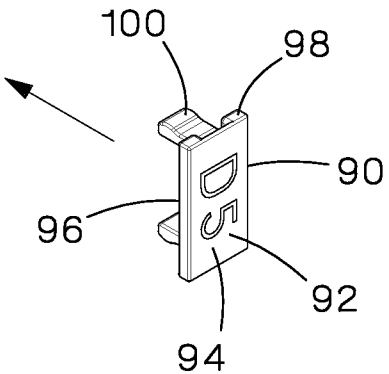
FIG. 2 is an exploded perspective view of a terminal marker of the present invention positioned to be installed in a terminal block.
Figure 2:
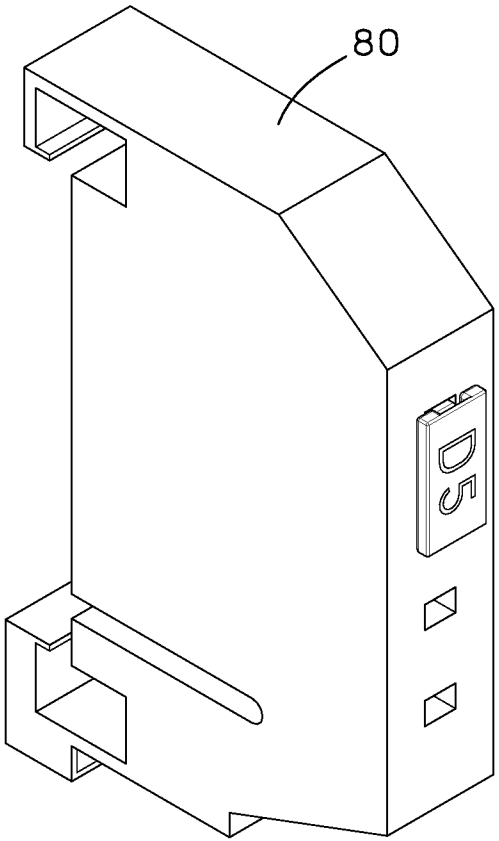
Figure 3A:
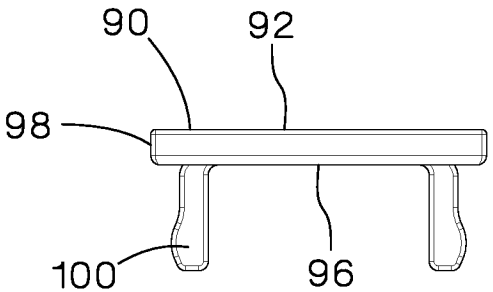
FIG. 3A is a front view of the terminal marker of FIG. 2 in an installed state.
Figure 3B:
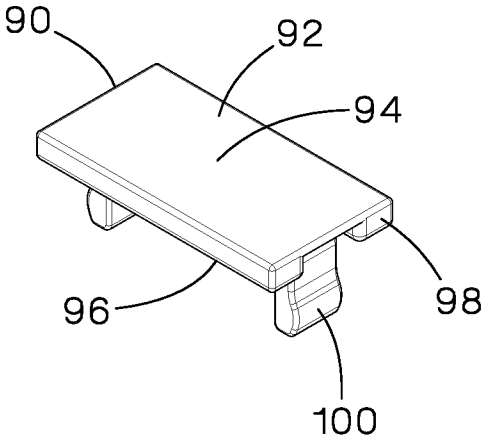
FIG. 3B is a top perspective view of the terminal marker of FIG. 3A.
Figure 3C:
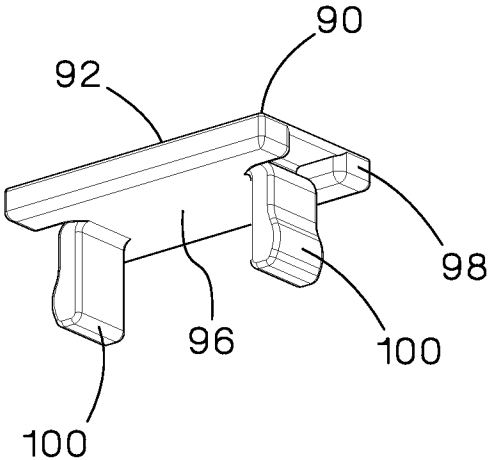
FIG. 3C is a bottom perspective view of the terminal marker of FIG. 3A.

FIGS. 2-8 illustrate the flexible terminal marker 90 of the present invention. FIG. 2 illustrates the terminal marker 90 positioned to be inserted in the terminal block 80. The terminal marker 90 includes a front 92, a back 96 and two legs 100. The front 92 has a print surface 94. The back 96 may include an adhesive, if desired. The legs 100 are formed to flex or bend downwards at each side 98 of the terminal marker 90. Extra material is added to the thickness of the terminal marker 90 on each side 98 of the legs 100 to ensure a uniform thickness when the terminal marker 90 is in the compressed state (see FIG. 2A and FIGS. 5A-C). The uniform thickness is imperative to ensure even print quality.

FIGS. 3A-C and FIG. 4 illustrate the terminal marker 90 in the installed or natural state with the legs 100 flexed downward. The legs 100 are positioned at an angle with respect to the print surface 94 on the front 92 of the terminal marker 90.

The terminal marker 90 is injection molded or extruded in the installed state. The terminal marker 90 is made from a material having elastic properties, such as thermoplastic polyurethane, to enable the legs 100 of the terminal marker 90 to bend and flex to a compressed state (see FIGS. 2A, 5A-C, and 6) for installation into a printer. The material of the terminal marker also provides memory properties in which the legs 100 of the terminal marker 90 return to the installed or natural state, without force or manipulation by the user.

Figure 5C:
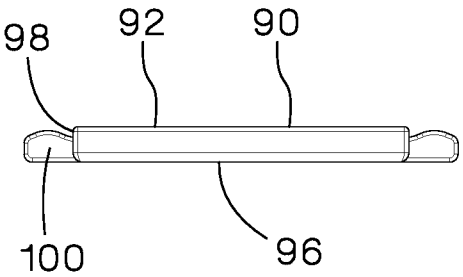
FIG. 5C is a front view of the terminal marker of FIG. 5A.
Figure 5B:
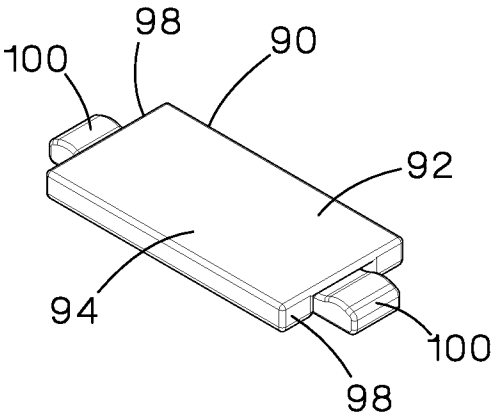
FIG. 5B is a top perspective view of the terminal marker of FIG. 5A.
Figure 5A:
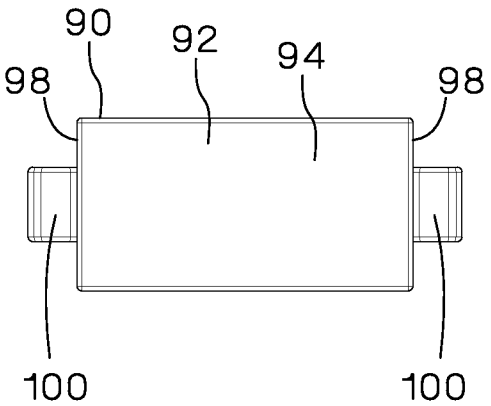
FIG. 5A is a top view of the terminal marker of FIG. 2 in a compressed state.

FIGS. 5A-C and FIG. 6 illustrate the terminal marker 90 in the compressed state. The terminal marker 90 of the present invention fits through a roll fed thermal transfer printer when the legs 100 are folded up or compressed into the terminal marker 90. The compressed terminal marker 90 creates an even print surface 94, as illustrated in FIGS. 5A-C.

Figure 4:
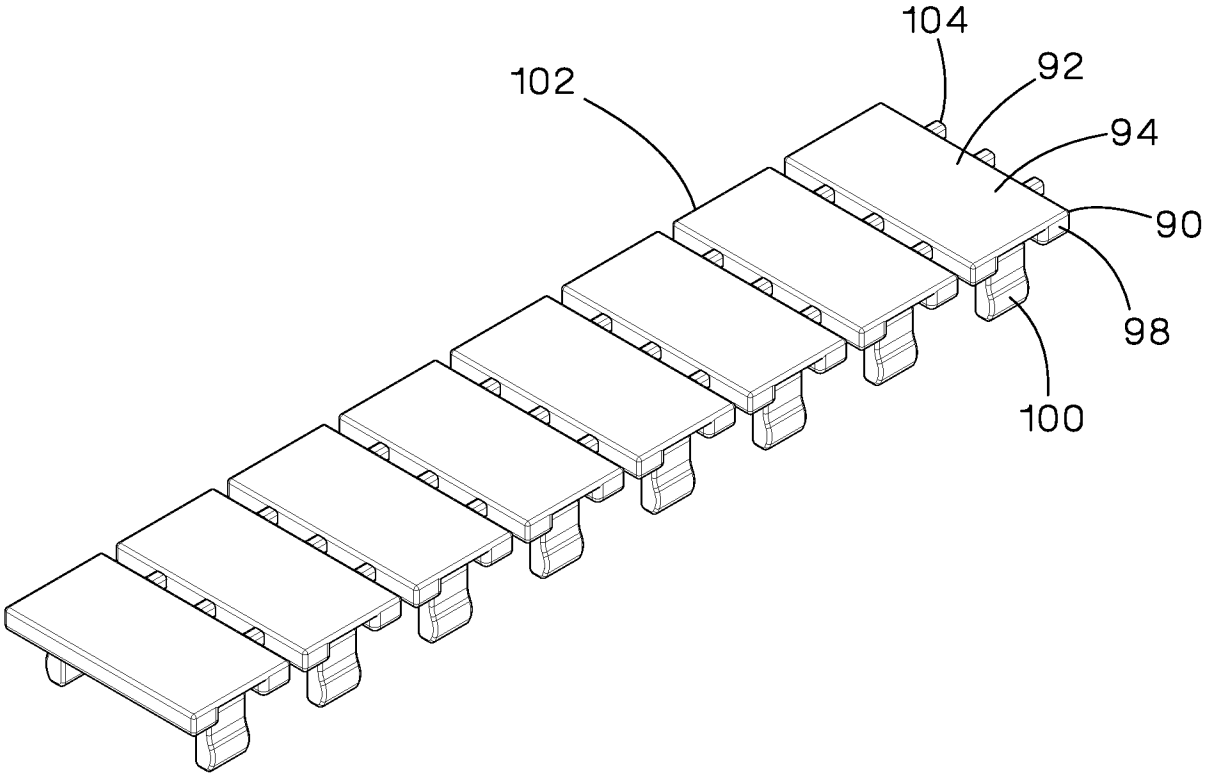
FIG. 4 is a top perspective view of a continuous strip of the terminal marker of FIG. 3A.
Figure 6:
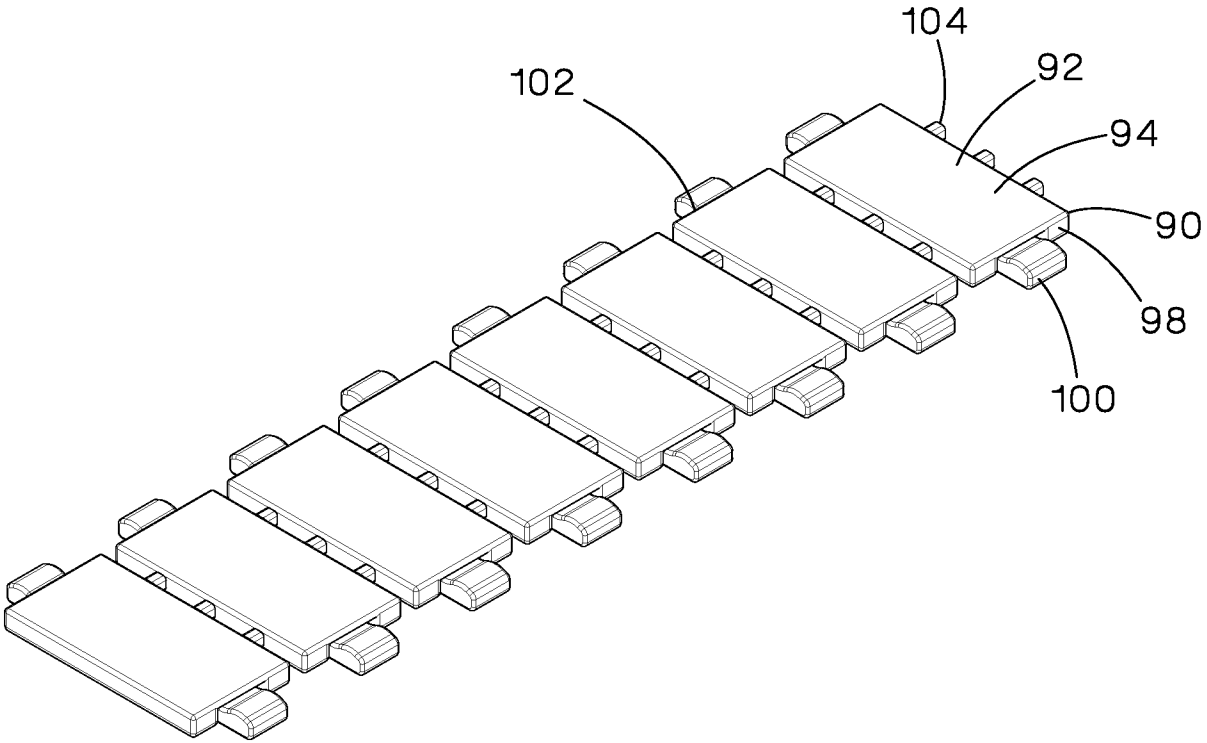
FIG. 6 is a top perspective view of a continuous strip of the terminal marker of FIG. 5A.

FIGS. 4 and 6 illustrate the terminal marker 90 in a continuous strip 102 with perforations 104 between each terminal marker 90. The legs 100 of the terminal markers 90 fold up into the compressed position (FIG. 6) when they encounter the nip roller of the printer and pass under the printhead in the compressed position. The terminal markers can be fed through a printer as a continuous strip or as a continuous roll.

Figure 8:
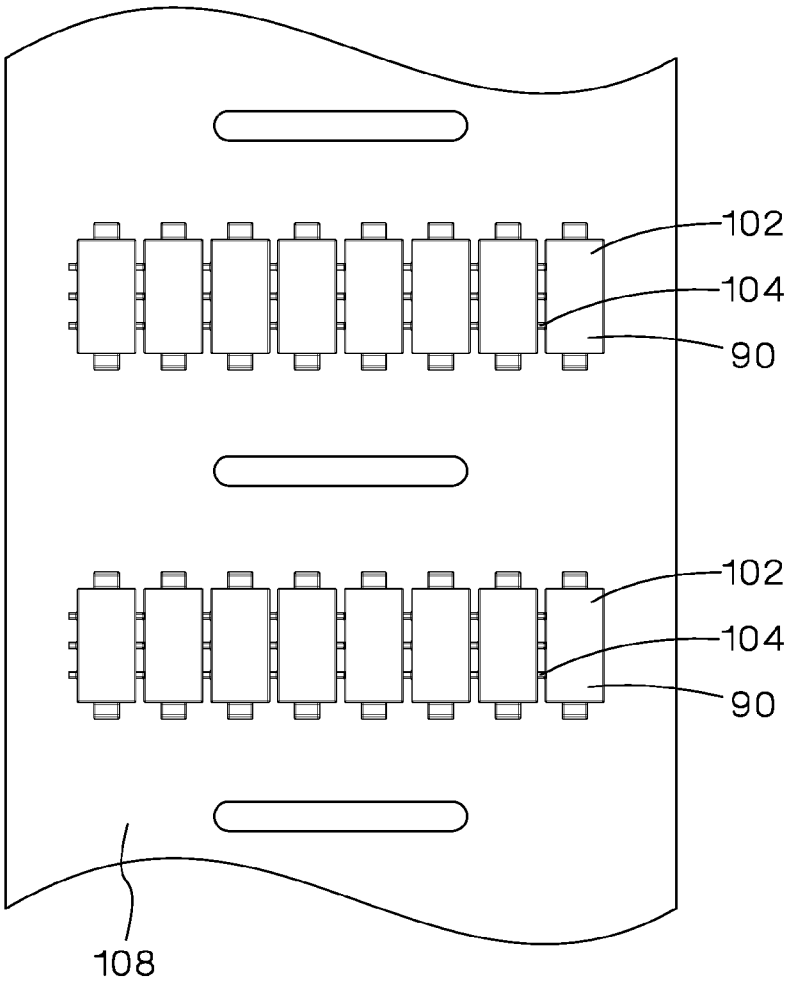
FIG. 8 is a top view of two continuous strips of FIG. 6 affixed to a liner.
Figure 7:
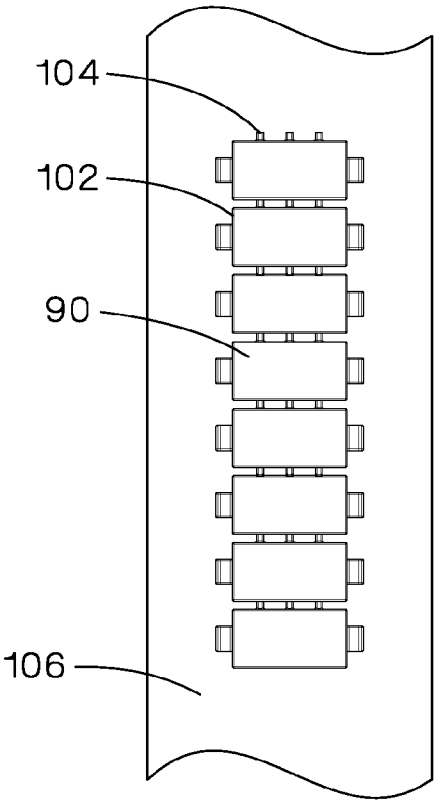
FIG. 7 is top view of the continuous strip of FIG. 6 affixed to a liner.
Figure 9A:
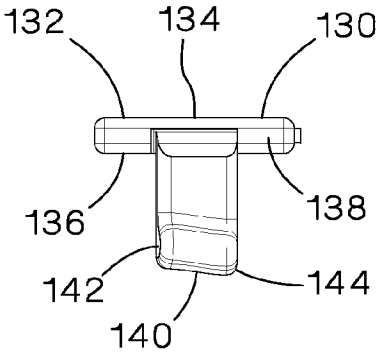
FIG. 9A is a side view of an alternative terminal marker of the present invention.
Figure 9B:
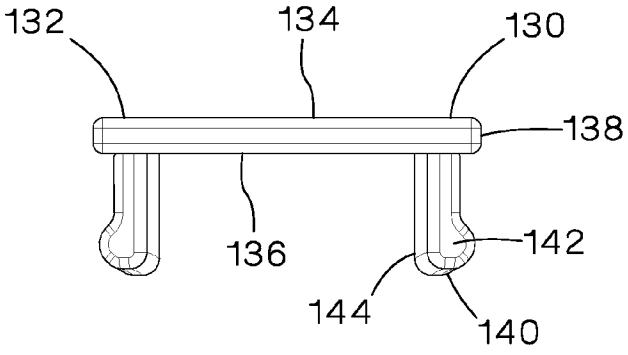
FIG. 9B is a front view of the terminal marker of FIG. 9A.
Figure 9C:
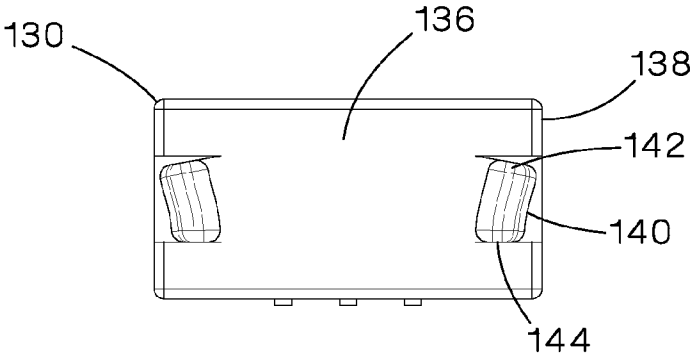
FIG. 9C is a bottom view of the terminal marker of FIG. 9A.
Figure 10:
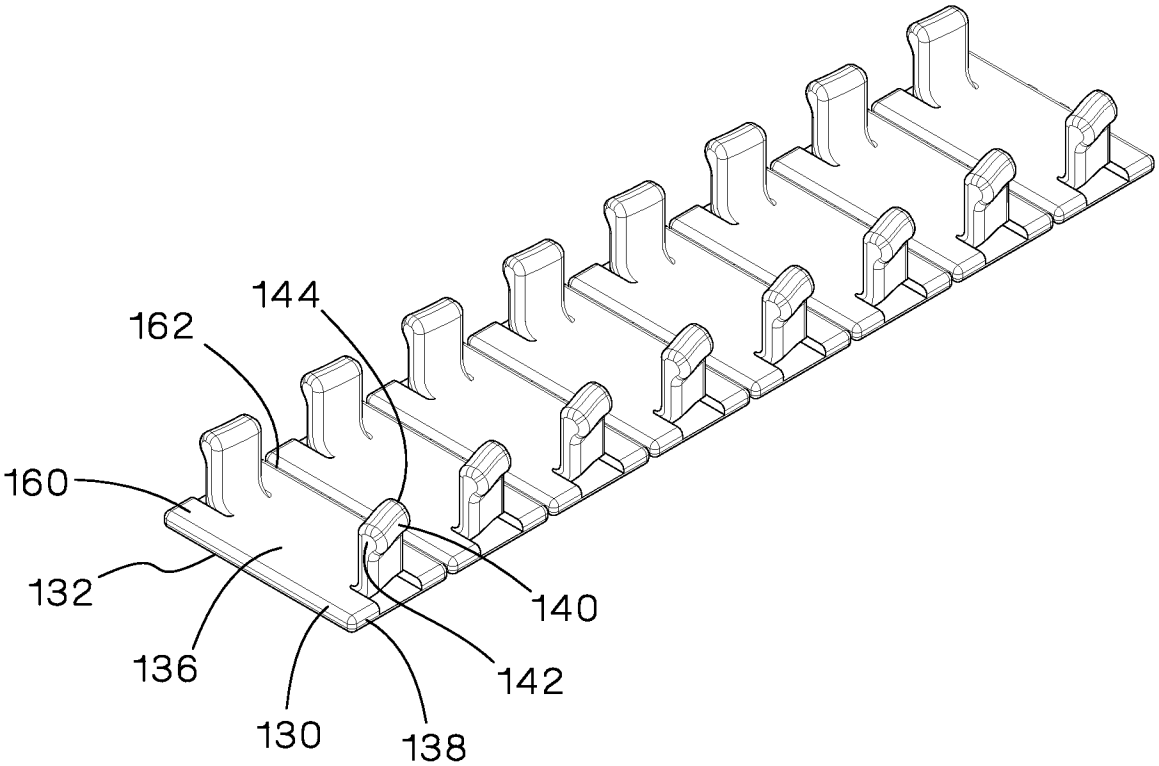
FIG. 10 is a bottom perspective view of a continuous strip of the terminal marker of FIG. 9A.
Figure 11B:
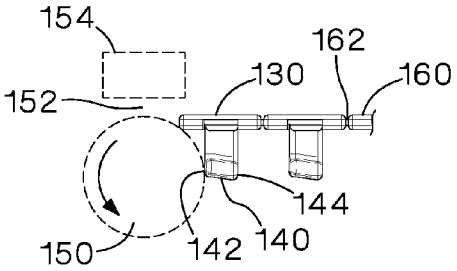
FIG. 11B is a side view of the continuous strip of the terminal marker and the print head assembly of FIG. 11A.
Figure 12B:
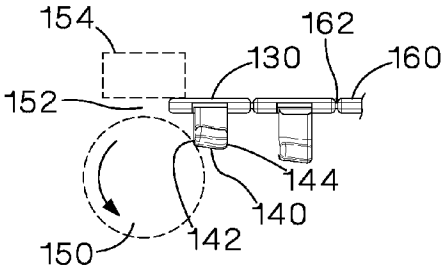
FIG. 12B is a side view of the print head assembly of FIG. 12A with the nip roller engaging the inside of the feet of the terminal marker.

FIGS. 7 and 8 illustrate the continuous strip 102 of the terminal marker 90 affixed to various liners. To package the terminal markers 90 for optimal printer feeding, the terminal marker strips 102 can be affixed to a liner 106, 108 in the compressed state. The back 96 of the terminal markers 90 would include an adhesive to adhere the terminal markers 90 to the liner 106, 108 thereby forcing the legs 100 out to the side. After printing, the terminal marker 90 can be peeled from the liner 106, 108 and the properties of the terminal marker material will pull the legs 100 down to the proper angle of the installed state. The terminal markers 90 may be placed on the liner 106 in a continuous line similar to continuous heat shrink labels, as illustrated in FIG. 7. Alternatively, terminal marker strips 102 of a predetermined length may be placed on a liner 108 similar to die cut heat shrink labels, as illustrated in FIG. 8.

FIGS. 9A-C through FIG. 14A illustrate an alternative terminal marker 130 of the present invention. The alternative terminal marker 130 includes a front 132 with a print surface 134, a back 136, and legs 140 that flex downward from each side 138. The legs 140 include a front 142 and a back 144. As illustrated in FIGS. 9A-C and FIG. 10, the front 142 of each leg 140 is angled upwards. The front 142 of each leg is also wider and rotated out with respect to the back 144 of the leg 140. The angled and rotated front 142 of the legs 140 facilitates folding the legs 140 as it makes contact with the nip roller and is pulled under the printhead to enable the terminal marker 130 to advance through a printer.

Figure 13B:
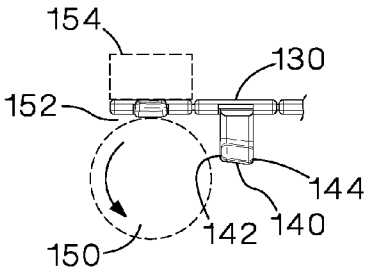
FIG. 13B is a side view of the print head assembly of FIG. 13A with the terminal marker positioned between the print head and the nip roller.
Figure 11A:
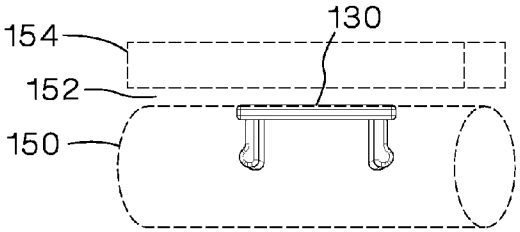
FIG. 11A is a front view of a continuous strip of the terminal marker of FIG. 9A positioned to be received by a print head assembly.
Figure 12A:
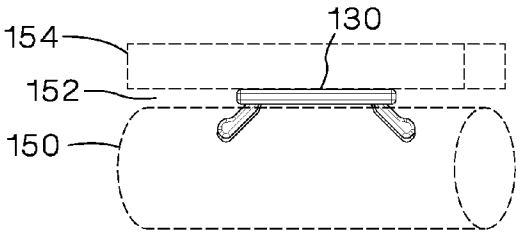
FIG. 12A is a front view of the print head assembly of FIG. 11A with the nip roller engaging the inside of the feet of the terminal marker.
Figure 13A:
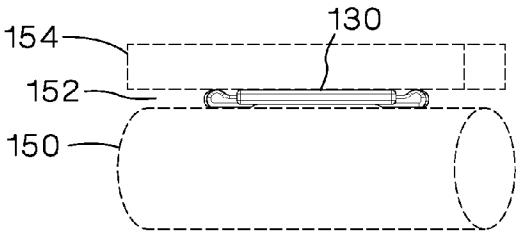
FIG. 13A is a front view of the print head assembly of FIG. 11A with the legs of the terminal marker compressed as the terminal marker is positioned in the print head assembly.

FIGS. 11A-B, 12A-B, and 13A-B illustrate the terminal marker 130 and a print head assembly as the print head assembly engages the terminal marker 130. The legs 140 are aligned to feed into the gap 152 between the nip roller 150 and the print head 154 (FIGS. 11 A-B). The nip roller 150 engages the inside of the leg 140 (FIGS. 12A-B) and the rotation of the nip roller 150 opens and compresses the legs 140 as it pulls the terminal marker 130 into the gap 152 to be printed on (FIGS. 13A-13B). As a result, the terminal marker 130 provides a thin flat surface necessary for printing.

The terminal markers 130 can be fed through the printer in continuous strips 160 or as a continuous roll. The perforations 162 in between the terminal markers 130 enable easy removal of individual or small groups of terminal blocks, according to the customer's need. Alternatively, the terminal markers 130 can be affixed to a liner with registration slots on one side of the terminal marker 130 for printer registration.

As the terminal markers 130 move through the printer, the terminal markers 130 compress with the legs 140 folding up as the terminal marker 130 enters the gap 152 between the nip roller 150 and the print head 154. As a result, the terminal markers 130 of FIGS. 9A-C and 10 reduce production costs in the development and processing of the terminal markers 130 because compressing the terminal markers onto a liner and delivering the product to the customer in the compressed state is not necessary.

Figure 14A:
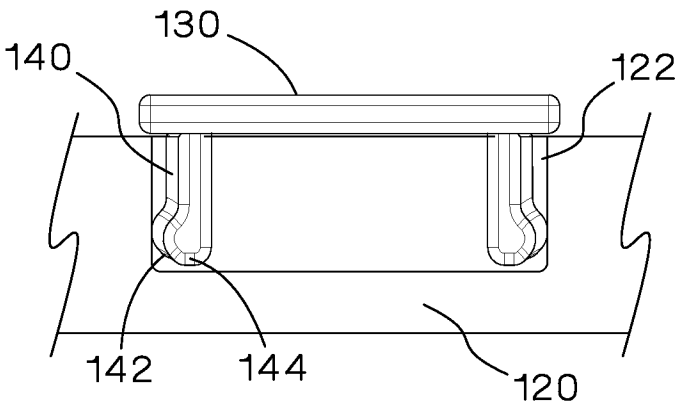
FIG. 14A is a front view of the terminal marker of FIG. 14 installed in the terminal block.
Figure 14:
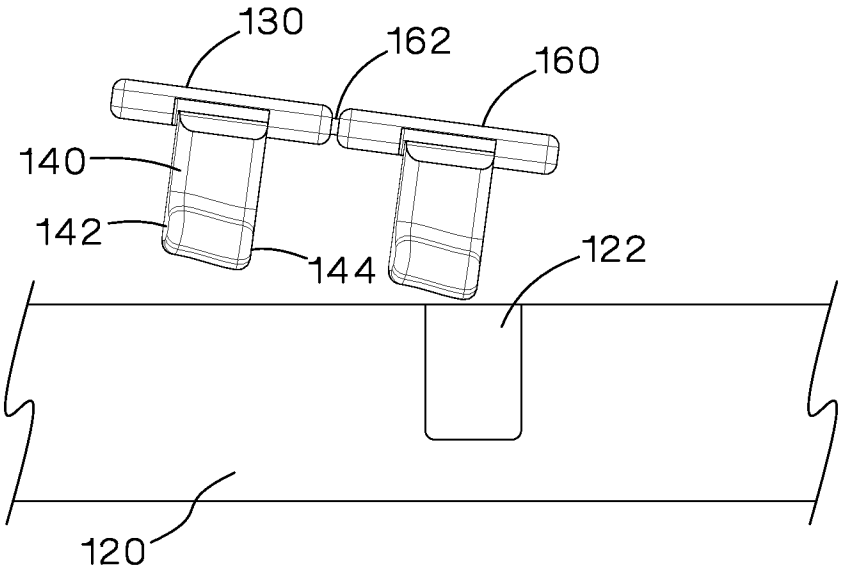
FIG. 14 is a side view of the terminal marker of FIG. 9A positioned to be installed in a terminal block.
Figure 15:
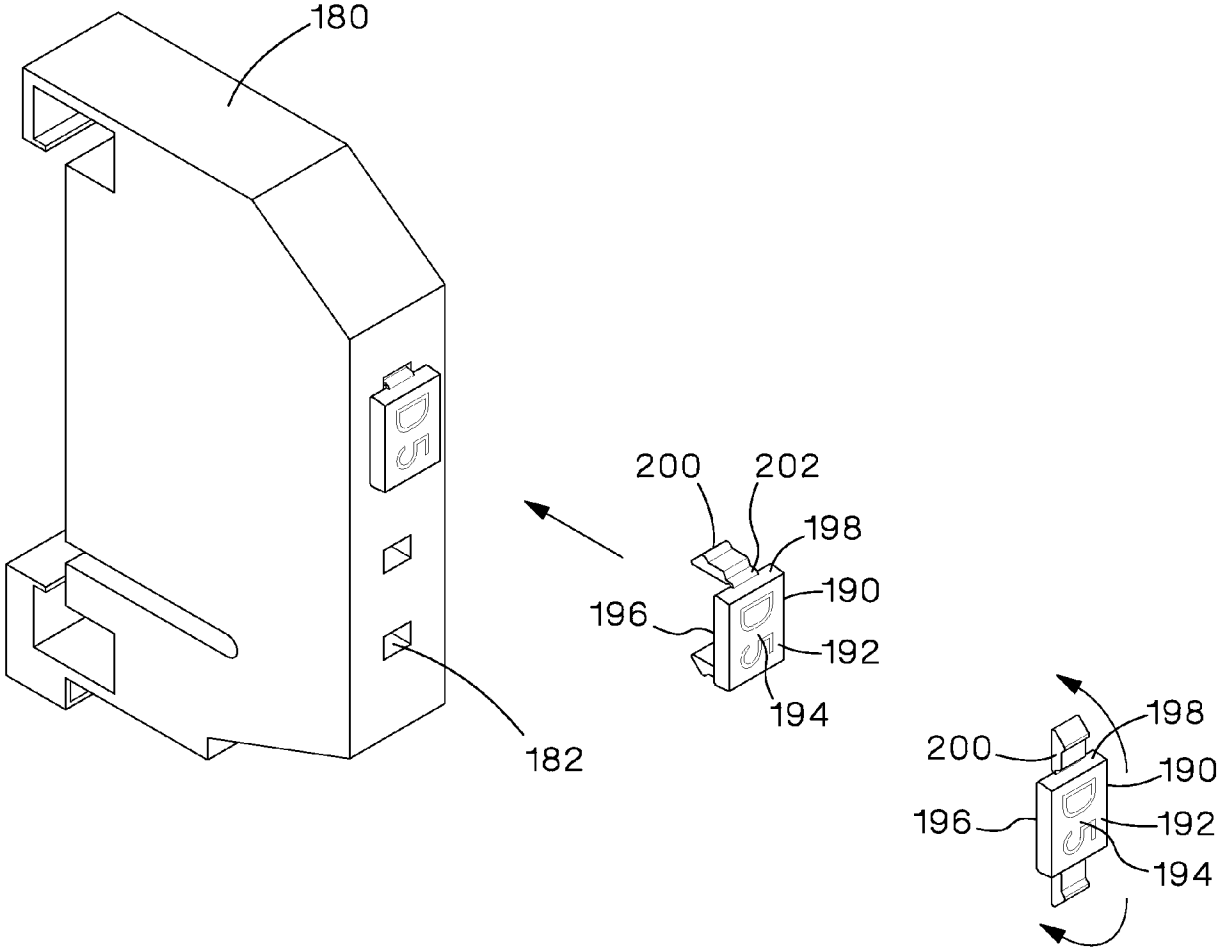
FIG. 15 is an exploded perspective view of an alternative terminal marker positioned to be installed in a terminal block.
Figure 16:
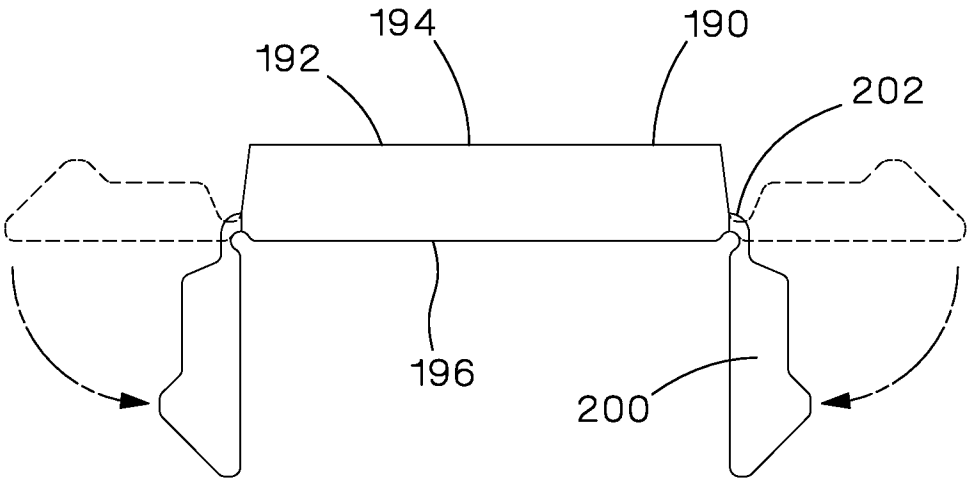
FIG. 16 is a front view of the terminal marker of FIG. 15 with legs attached via a living hinge.

FIG. 14 illustrates the terminal marker 130 positioned to be installed in the terminal block 120 and FIG. 14A illustrates the terminal marker 130 installed in the terminal block 120. Installation of the terminal marker 130 is best achieved by angling the back 144 of the leg 140 down slightly during insertion. The rotated legs 140 of the terminal marker 130 ensures that the back 144 of the leg 140 inserts easily into the terminal block opening 122 and guides the front 142 of the leg 140 into the opening 122 in one solid motion. As a result, the front 142 of the legs 140 slide into the opening 122 and snap into place.

As illustrated in FIG. 14A, when the terminal marker 130 is installed into the terminal block 120, the protruded front 142 of leg 140 provides a natural spring resistance to hold the terminal marker 130 in place. The legs 140 are designed to protrude out beyond the wall of the terminal block opening 122. The walls of the terminal block opening 122 force the front 142 of the leg 140 to rotate in line with the back 144 of the leg 140. This will create a spring force that will secure the terminal marker 130 in the opening 122 and will improve resistance to vibration.

FIGS. 15-18 illustrate an alternative terminal marker 190 of the present invention. The terminal marker 190 includes a front 192 with a print surface 194, a back 196, sides 198 and legs 200 attached to the sides 198. The alternative terminal maker 190 is designed to be printed in a standard thermal transfer printer and mounted to a terminal block 180 using the latching method typical of other terminal block marking systems. The terminal marker 190 is produced and packaged in a flat format for printing thereby allowing compatibility with a standard printer. After printed, the legs 200 would be folded to be perpendicular with the front side print surface 194 on the front 192. The terminal marker 190 can then be inserted in the terminal block openings 182 of the terminal block 180.

The terminal marker 190 is extruded from a flexible plastic resin. The legs 200 are attached with a living hinge 202, (see FIG. 16), allowing the legs 200 to be folded for installation. The terminal marker 190 is notched to reduce the leg width for proper fit in the terminal block 180 while maintaining the common width of the print surface 194.

Figure 17:
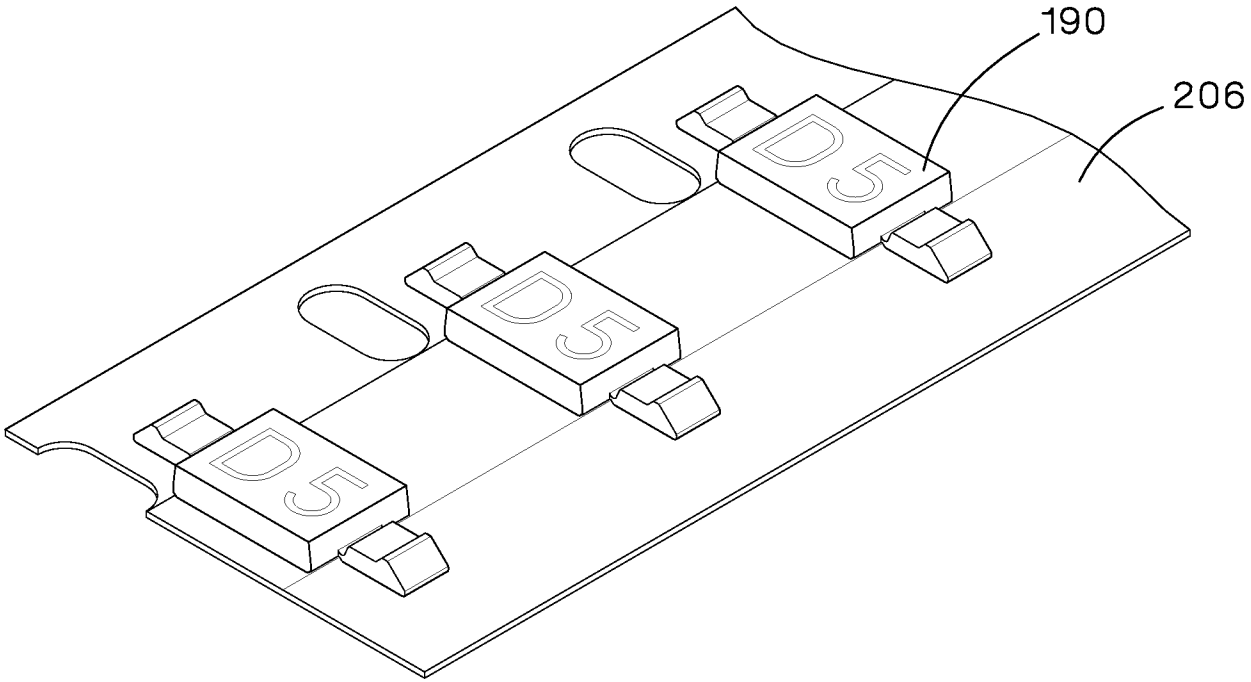
FIG. 17 is a top perspective view of the terminal marker of FIG. 15 attached to a liner.
Figure 18:
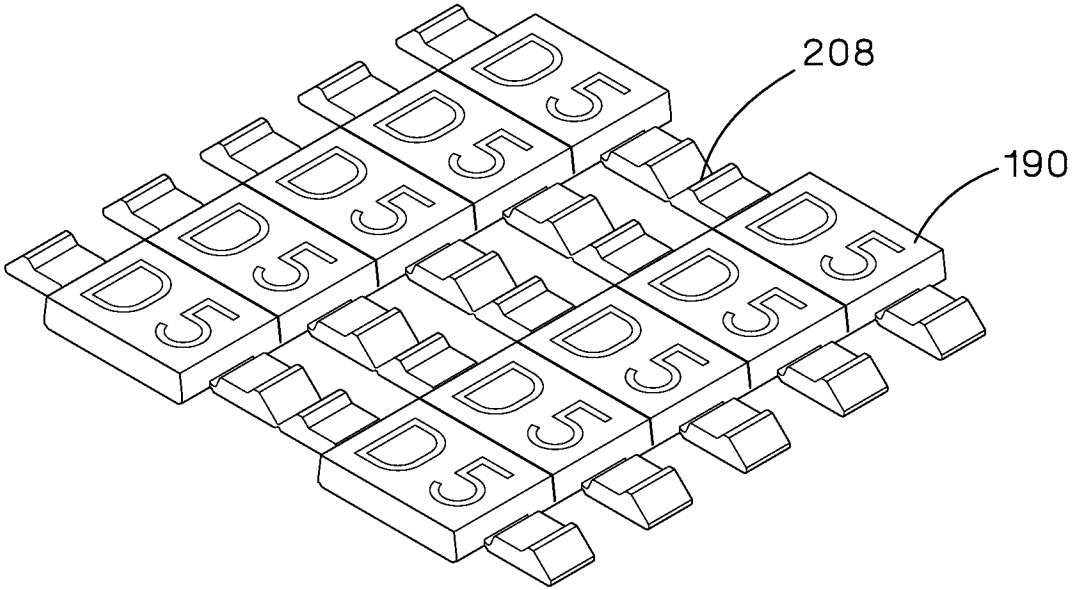
FIG. 18 is a top perspective view of the terminal marker of FIG. 15 in a multiple row format with each terminal marker separated by webbing.

The terminal markers 190 could be applied to a liner 206 for printing with cassette based or desktop printers (see FIG. 17). The terminal markers 190 could also be produced in multiple row format (see FIG. 18) with separable webbing 208 between the terminal markers 190 for optimum performance in desktop printers. After printing, the individual terminal markers 190 would be separated by tearing the webbing 208 holding them together. The printed terminal markers 190 would be ready to be installed in a terminal block 180.

Furthermore, while the particular preferred embodiments of the present invention have been shown and described, it will be obvious to those skilled in the art that changes and modifications may be made without departing from the teaching of the invention. The matter set forth in the foregoing description and accompanying drawings is offered by way of illustration only and not as limitation. The actual scope of the invention is intended to be defined in the following claims when viewed in their proper perspective based on the prior art.

What is claimed is:

1. A terminal marker for identifying a terminal block, the terminal marker comprising:

a front having a print surface, a back, sides, and flexible legs;

wherein the flexible legs are disposed in a natural state extending from the back perpendicular to the print surface of the terminal marker for installation in the terminal block; and wherein the flexible legs are disposed in a compressed state folded into the back and parallel to the print surface for obtaining a marking from a printer.

2. The terminal marker of claim 1, wherein the flexible legs having a front and a back, the front of each leg being rotated with respect to the back of the leg.

3. The terminal marker of claim 2, wherein the front of the flexible legs is angled upward.

4. The terminal marker of claim 1, wherein the flexible legs are attached to the sides by a living hinge.

5. The terminal marker of claim 1, wherein the flexible legs bend to a compressed state to accommodate printing, and thereafter return to a natural state with the flexible legs extending perpendicular at the angle with respect to the print surface.

6. The terminal marker of claim 1, wherein the terminal marker is formed in a continuous strip of a plurality of terminal markers, the terminal markers being separated by perforations.

7. The terminal marker of claim 1, wherein the flexible legs extend outward beyond the sides of the terminal marker in the compressed state.

8. The terminal marker of claim 1, wherein the sides have openings for receiving the flexible legs in the compressed state.

* * * * *